US007963005B2

(12) United States Patent
Knox

(10) Patent No.: US 7,963,005 B2
(45) Date of Patent: Jun. 21, 2011

(54) METHOD AND APPARATUS FOR FASTENING OBJECTS TO AN ELASTIC SURFACE

(76) Inventor: Gregory H. C. Knox, San Diego, CA (US)

( * ) Notice: Subject to any disclaimer, the term of this patent is extended or adjusted under 35 U.S.C. 154(b) by 326 days.

(21) Appl. No.: 12/062,418

(22) Filed: Apr. 3, 2008

(65) Prior Publication Data

US 2009/0249583 A1 Oct. 8, 2009

(51) Int. Cl.
*A44B 21/00* (2006.01)

(52) U.S. Cl. ..... 24/3.1; 24/3.13; 206/478; 224/682; 224/676

(58) Field of Classification Search ..... 24/3.1, 24/3.13; 206/0.82, 0.8, 477, 478, 479, 480; 2/338, 311, 336, 337; 224/250, 684, 572, 224/650, 651, 919

See application file for complete search history.

(56) References Cited

U.S. PATENT DOCUMENTS

| | | | | | |
|---|---|---|---|---|---|
| 878,897 | A * | 2/1908 | Reynolds | 2/338 |
| 1,201,979 | A * | 10/1916 | Noyes | 206/478 |
| 1,273,377 | A * | 7/1918 | Josephson | 206/478 |
| 1,422,872 | A * | 7/1922 | Loman | 24/3.12 |
| 1,424,139 | A * | 7/1922 | Loman | 24/3.12 |
| 1,842,072 | A * | 1/1932 | Collingbourne | 206/478 |
| 1,939,642 | A * | 12/1933 | Barnes | 206/348 |
| 2,082,346 | A * | 6/1937 | Lavenson | 428/131 |
| 2,375,087 | A * | 5/1945 | De Bruin | 206/577 |
| 2,645,340 | A * | 7/1953 | Dow | 206/478 |
| 2,878,013 | A * | 3/1959 | Piodi | 267/69 |
| 2,885,685 | A * | 5/1959 | Carr et al. | 2/321 |
| 4,151,936 | A * | 5/1979 | Hawkes | 224/676 |
| 4,413,762 | A * | 11/1983 | Carini | 224/250 |
| 4,597,493 | A * | 7/1986 | Bruso | 206/363 |
| 4,865,097 | A * | 9/1989 | Allen | 150/154 |
| 4,946,030 | A * | 8/1990 | Guridi et al. | 206/37.1 |
| 5,432,951 | A * | 7/1995 | Yewer, Jr. | 2/44 |
| 5,842,621 | A * | 12/1998 | Gschwind | 224/682 |
| 5,950,844 | A * | 9/1999 | Taylor | 211/85.7 |
| 5,957,456 | A * | 9/1999 | Tullos | 273/269 |
| 6,053,310 | A * | 4/2000 | Mandel et al. | 206/0.81 |
| 6,082,602 | A * | 7/2000 | Gschwind | 224/682 |
| 7,743,885 | B2 * | 6/2010 | Martin et al. | 182/3 |
| 2006/0102498 | A1 * | 5/2006 | Guenther | 206/170 |
| 2009/0057508 | A1 * | 3/2009 | George | 248/205.1 |

* cited by examiner

*Primary Examiner* — Robert J Sandy
*Assistant Examiner* — Rowland D Do
(74) *Attorney, Agent, or Firm* — Charles F. Reidelbach, Jr.

(57) ABSTRACT

A method and apparatus for attaching an object to an elastic surface includes an elastic surface and a first flexible, linear fastener attached to the elastic surface by at least two opposite ends separated by a distance that is less than a diameter of an object to be fastened to the elastic surface. A second flexible, linear fastener is attached to the elastic surface by at least two opposite ends separated by a distance that is less than a diameter of an object to be fastened to the elastic surface. The first linear fastener and the second linear fastener are separated by a distance sufficient to insert a leading edge of the object between the first linear fastener and the elastic surface and to insert a trailing edge of the object between the second linear fastener and the elastic surface so that the first linear fastener and the second linear fastener hold the object against the elastic surface.

9 Claims, 4 Drawing Sheets

METHOD AND APPARATUS FOR FASTENING OBJECTS TO AN ELASTIC SURFACE

BACKGROUND OF THE INVENTION

1. Field of the Invention

The present invention is directed to fasteners for attaching an object to an elastic surface. More specifically, but without limitation thereto, the present invention is directed to a method and fastener for attaching an object to an article of clothing.

2. Description of Related Art

Articles of clothing are commonly used to display decorations. For example, fishing flies are mounted on hat bands, coins are mounted on belt buckles, and so on. These decorations are typically mounted on the article of clothing by fasteners such as clasps, pins, and pronged settings.

SUMMARY OF THE INVENTION

In one embodiment, a method for attaching an object to an elastic surface includes steps of providing an elastic surface and providing a first flexible, linear fastener attached to the elastic surface by at least two opposite ends separated by a distance that is less than a diameter of an object to be fastened to the elastic surface. A second flexible, linear fastener is attached to the elastic surface by at least two opposite ends separated by a distance that is less than a diameter of an object to be fastened to the elastic surface. The leading edge of the object is inserted between the first linear fastener and the elastic surface. The trailing edge of the object is inserted between the second linear fastener and the elastic surface so that the first linear fastener and the second linear fastener hold the object against the elastic surface.

In another embodiment, an apparatus for attaching an object to an elastic surface includes an elastic surface and a first flexible, linear fastener attached to the elastic surface by at least two opposite ends separated by a distance that is less than a diameter of an object to be fastened to the elastic surface. A second flexible, linear fastener is attached to the elastic surface by at least two opposite ends separated by a distance that is less than a diameter of an object to be fastened to the elastic surface. The first linear fastener and the second linear fastener are separated by a distance sufficient to insert a leading edge of the object between the first linear fastener and the elastic surface and to insert a trailing edge of the object between the second linear fastener and the elastic surface so that the first linear fastener and the second linear fastener hold the object against the elastic surface.

BRIEF DESCRIPTION OF THE DRAWINGS

The above and other aspects, features and advantages will become more apparent from the description in conjunction with the following drawings presented by way of example and not limitation, wherein like references indicate similar elements throughout the several views of the drawings, and wherein.

Elements in the figures are illustrated for simplicity and clarity and have not necessarily been drawn to scale. For example, the dimensions, sizing, and/or relative placement of some of the elements in the figures may be exaggerated relative to other elements to clarify distinctive features of the illustrated embodiments. Also, common but well-understood elements that may be useful or necessary in a commercially feasible embodiment are often not depicted in order to facilitate a less obstructed view of the illustrated embodiments.

DESCRIPTION OF THE ILLUSTRATED EMBODIMENTS

The following is a description of specific examples that embody general principles from which other embodiments may be derived. Accordingly, the illustrated embodiments are not intended to exclude other embodiments that may be derived from the same general principles within the scope of the appended claims. For example, certain actions or steps may be described or depicted in a specific order to be performed. However, practitioners of the art will understand that the specific order is only given by way of example and that the specific order does not exclude performing the described steps in another order to achieve substantially the same result. Also, the terms and expressions used in the description have the ordinary meanings accorded to such terms and expressions in the corresponding respective areas of inquiry and study except where other meanings have been specifically set forth herein.

Articles of clothing are frequently used to display ornaments such as campaign buttons, and so on. While some ornaments have pins to fasten them to the article of clothing, other items such as coins may not be so easily fastened without modifying the coins or fashioning an elaborate mounting. Disadvantageously, the coins may not be easily replaced using previous fasteners. The linear fastener described below overcomes these disadvantages and may provide other advantages for fastening objects to an elastic surface.

Figure 1:
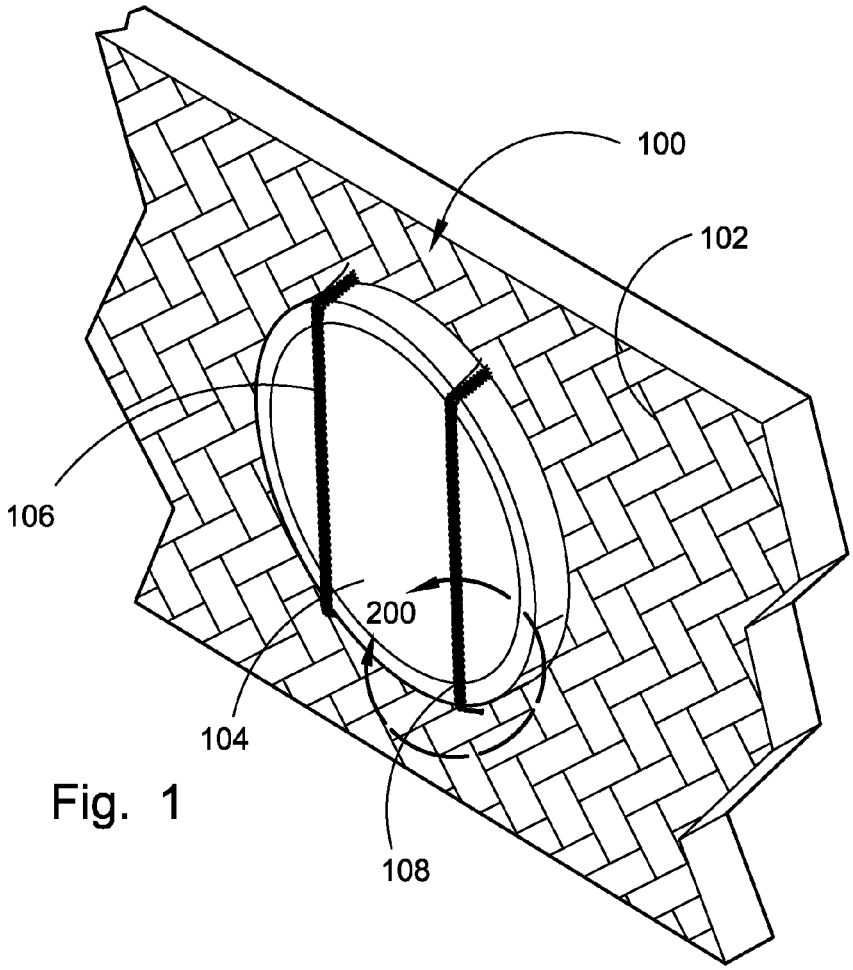
FIG. 1 illustrates a perspective view of an embodiment of a linear fastener for an elastic surface.

FIG. 1 illustrates a top view 100 of an embodiment of a linear fastener for an elastic surface. Shown in FIG. 1 are an elastic surface 102, an object 104 to be fastened, and linear fasteners 106 and 108.

In FIG. 1, the elastic surface 102 may be, for example, a stretch fabric used in suspenders, belts, hatbands, headbands, armbands, garters, and so on. Other fabrics and materials that may also be expanded and contracted by hand force may be used to practice various embodiments within the scope of the appended claims. Generally, an elastic surface comprises a material that may be stretched, flexed, or otherwise changed in shape by applying tension to the material without permanently deforming the material. Accordingly, the material may return to its original size and shape when the tension is removed, in contrast to metals, plastics, and other hard materials that may not be as easily restored to their original shape when the tension is removed.

The object 104 may be, for example, a ship's coin, a monetary coin, a campaign button, a photograph, a postage stamp, or any of a variety of objects of various shapes and sizes. In the example of FIG. 1, the object 104 is a flat, round coin such as a ship's coin or a monetary coin. Ship's coins are souvenir coins presented as tokens of appreciation to guests and crew of Navy ships and submarines. Monetary coins may be U.S. or foreign coinage having the shape of circles or polygons. Campaign buttons are generally disc-shaped and are often worn to support and protest political candidates and issues. Photographs and postage stamps may be laminated and mounted on a suitable backing for display on an article of clothing.

The linear fasteners 106 and 108 are preferably made of a highly flexible material such as a length of thread. The flexible material may also be somewhat elastic; however, elasticity is not required, and too much elasticity may compromise the capability of the linear fasteners 106 and 108 to hold the object 104 on the elastic surface 102 during sudden movements. The linear fasteners 106 and 108 are each sewn or otherwise anchored to the elastic surface 102 according to well-known techniques at opposite ends of each of the linear fasteners 106 and 108. The ends of each of the linear fasteners 106 and 108 are separated by a distance that is less than the diameter of the object 104 to prevent the object 104 from slipping completely through either of the linear fasteners 106 and 108. For objects that have a non-circular shape, the term "diameter" is used to mean the width of the smallest aperture through which the object 104 may pass. The linear fasteners 106 and 108 are also separated from each other by a distance that is less than the diameter of the object 104 to hold the object 104 between the linear fasteners 106 and 108 against the elastic surface 102.

In other embodiments, the linear fasteners 106 and 108 may be oriented in different directions to suit specific applications within the scope of the appended claims. For example, the linear fasteners 106 and 108 may be oriented on the elastic surface 102 diagonally, parallel, or perpendicular to the direction of the weight vector of the object 104 to hold the object 104 on the elastic surface 102. The direction of the weight vector of the object 104 is the direction that the object 104 would fall if the object 104 were released from the linear fasteners 106 and 108. The parallel orientation of the linear fasteners 106 and 108 in FIG. 1 may be preferable, for example, in a hatband.

The object 104 may be fastened to the elastic surface 102, for example, by inserting the leading edge of the object 104 between the linear fastener 106 and the elastic surface 102. The leading edge of the object 104 may be, for example, the edge opposite to the edge used to grip the object 104 in one hand. The object 104 may then be released while gripping the leading edge of the object 104 with the other hand to hold the object 104 inside the linear fastener 106. The middle of the linear fastener 108 may then be pulled with the free hand in a direction away from the center of the object 104 over the top of the trailing edge of the object 104 to hold the trailing edge of the object 104 inside the linear fastener 108. Likewise, the object 104 may be removed from the linear fasteners 106 and 108 by reversing the fastening procedure.

Figure 2:
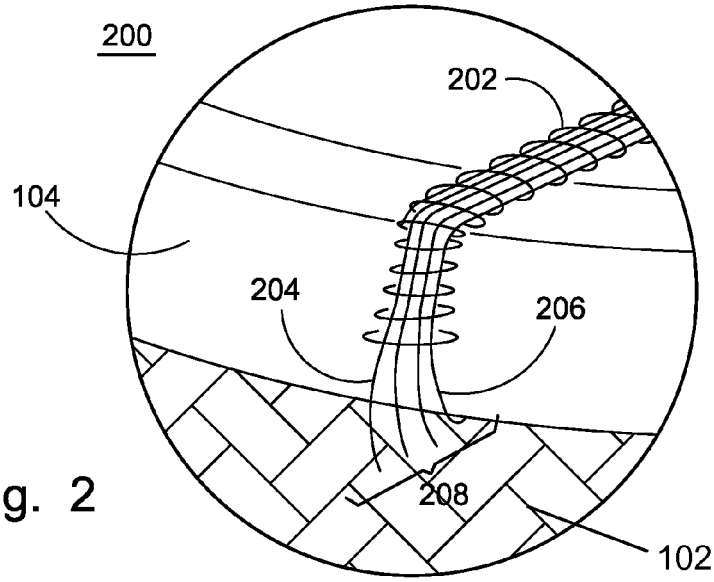
FIG. 2 illustrates a magnified view of a portion of the linear fastener of FIG. 1.

FIG. 2 illustrates a magnified view 200 of a portion of the linear fastener 108 of FIG. 1. Shown in FIG. 2 are an elastic surface 102, an object 104 to be fastened, a wrapping stitch 202, an outer overhand stitch 204, an inner overhand stitch 206, and an anchor point range 208.

In FIG. 2, the linear fastener 108 includes a number of overhand stitches including the outer overhand stitch 204 and the inner overhand stitch 206. The overhand stitches including the outer overhand stitch 204 and the inner overhand stitch 206 are attached to the elastic surface 102 at opposite ends of the linear fastener 108, for example, according to well-known sewing techniques. The points where the overhand stitches including the outer overhand stitch 204 and the inner overhand stitch 206 are attached to the elastic surface 102 are referred to herein as anchor points. The anchor points at one end of the linear fastener 108 are shown collectively as the anchor point range 208. The outer overhand stitch 204 is attached to the elastic surface 102 at an anchor point at the end of the anchor point range 208 that lies outside the object 104. The inner overhand stitch 206 is attached to the elastic surface 102 at an anchor point at the end of the anchor point range 208 that lies under the object 104.

The wrapping stitch 202 is sewn around the overhand stitches including the outer overhand stitch 204 and the inner overhand stitch 206, for example, according to well-known sewing techniques. In various embodiments, 10 to 30 overhand stitches may be bundled inside the wrapping stitch 202. In another embodiment, the wrapping stitch 202 is also attached to the elastic surface 102 at an anchor point inside the anchor point range 208.

In further embodiments, the wrapping stitch 202 and the overhand stitches including the outer overhand stitch 204 and the inner overhand stitch 206 are made of, for example, sewing thread, string, fishing line, ribbon, or other linear, flexible material. In other embodiments, the wrapping stitch 202 is omitted. In another embodiment, a single overhand stitch is attached to opposite ends of the elastic surface 102 inside the anchor point range 208 instead of multiple stitches. In other embodiments, the linear, flexible material of the linear fastener 108 may be colored or transparent.

When tension is applied to the elastic surface 102 in a direction parallel to the linear fastener 108 and away from the center of the object 104, the anchor points at opposite ends of the linear fastener 108 near the outer overhand stitch 204 are moved further apart, which results in tightening the linear fastener 108 against the object 104 and the elastic surface 102. On the other hand, when tension is applied to the elastic surface 102 in a direction parallel to the linear fastener 108 and toward the center of the object 104, the anchor points at opposite ends of the linear fastener 108 near the inner overhand stitch 206 are moved closer together, which also results in tightening the linear fastener 108 against the object 104 and the elastic surface 102. As a result, tension applied to the elastic surface 102 in either direction parallel to the linear fastener 108 results in holding the object 104 more securely against the elastic surface 102, advantageously avoiding accidental release of the object 104 during stretching movements of the elastic surface 102. For optimum results, it is preferable that the linear fasteners 106 and 108 not be made of an elastic material to avoid accidentally releasing the object 104 during sudden motions of the person wearing or handling an article of clothing comprising the elastic surface 102.

Figure 3:
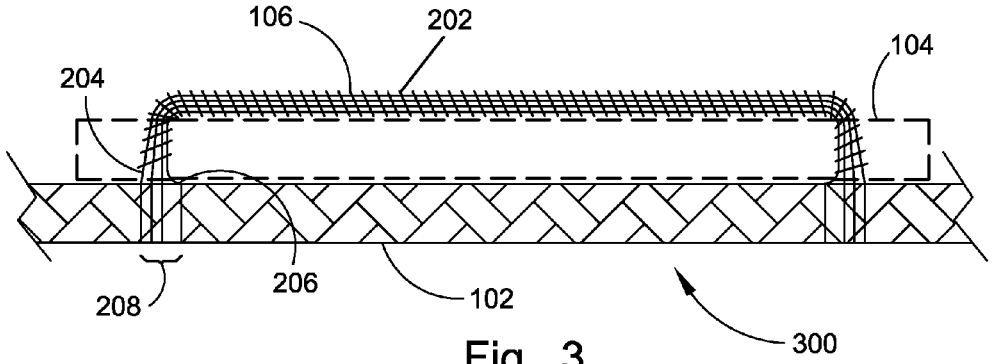
FIG. 3 illustrates a side view of the linear fastener of FIG. 1.

FIG. 3 illustrates a side view 300 of the linear fastener of FIG. 1. Shown in FIG. 3 are an elastic surface 102, an object 104 to be fastened, a linear fastener 106, a wrapping stitch 202, an outer overhand stitch 204, an inner overhand stitch 206, and an anchor point range 208.

In FIG. 3, the stitches of the linear fastener 106 are anchored between the outer overhand stitch 204 and the inner overhand stitch 206 within the anchor point range 208 at the opposite ends of the linear fastener 106 so that the anchor points lie on a line that is generally parallel to the direction of the linear fastener 106 across the top of the object 104.

Figure 4:
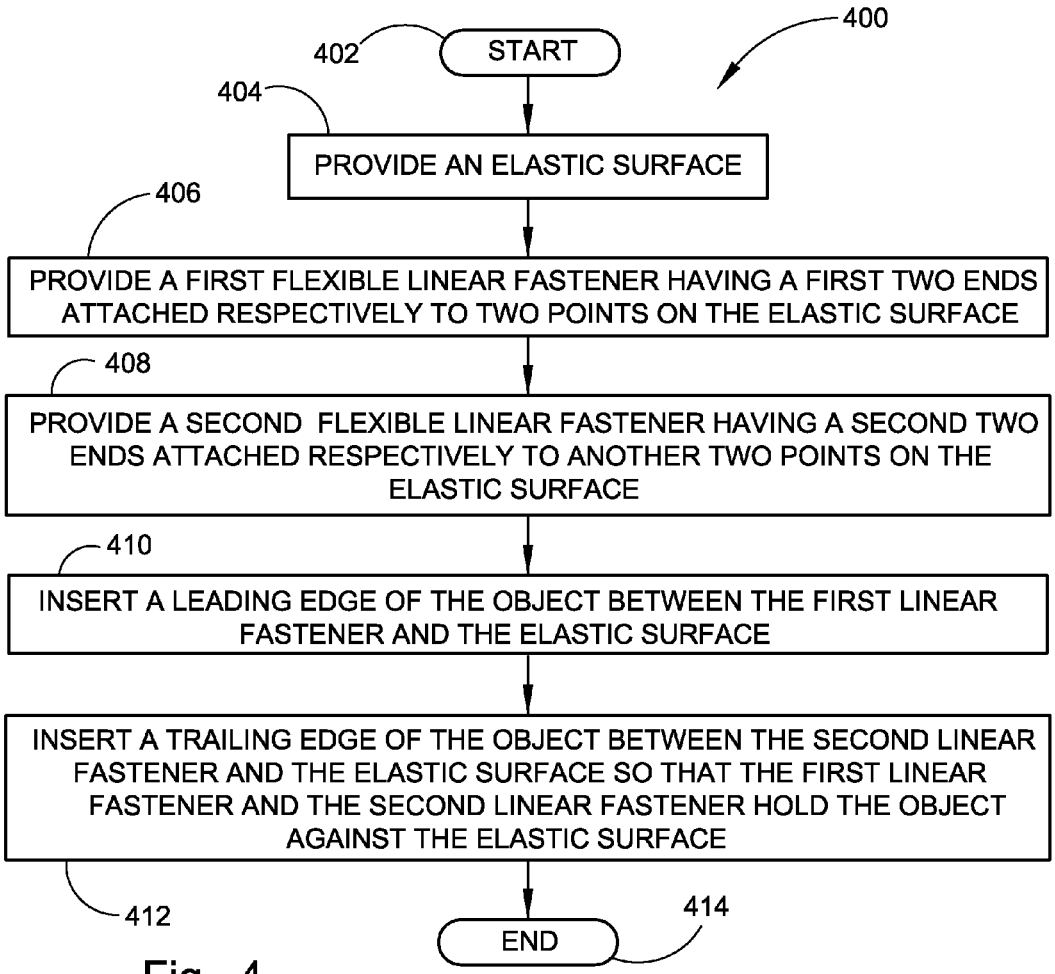
FIG. 4 illustrates a flow chart for a method of fastening an object to an elastic surface using the linear fastener of FIG. 1.

FIG. 4 illustrates a flow chart 400 for a method of fastening an object to an elastic surface using the linear fastener of FIG. 1.

Step 402 is the entry point of the flow chart 400.

In step 404, an elastic surface is provided. The elastic surface may be, for example, an article of clothing such as a pair of suspenders, a hat band, a headband, an armband, a belt, or a garter.

In step 406, a first flexible, linear fastener is attached to the elastic surface by at least two opposite ends separated by a distance that is less than a diameter of an object to be fastened to the elastic surface. For example, the distance separating the two opposite ends may be one-half the diameter of the object.

In step 408, a second flexible, linear fastener is attached to the elastic surface by at least two opposite ends separated by a distance that is less than a diameter of an object to be fastened to the elastic surface.

In step 410, a leading edge of the object is inserted between the first linear fastener and the elastic surface, for example, as described above.

In step 412, a trailing edge of the object is inserted between the second linear fastener and the elastic surface so that the first linear fastener and the second linear fastener hold the object against the elastic surface.

Step 414 is the exit point of the flow chart 400.

Figure 5:
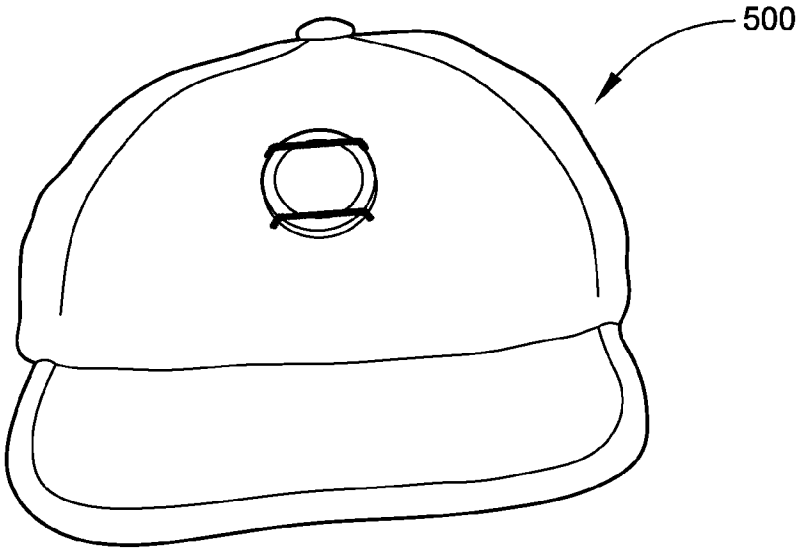
FIG. 5 illustrates a perspective view of an embodiment of the linear fastener of FIG. 1 sewn on a hat for displaying a coin.

FIG. 5 illustrates a perspective view 500 of an embodiment of the linear fastener of FIG. 1 sewn on a hat for displaying a coin.

In FIG. 5, the linear fasteners may be oriented horizontally as shown, vertically, or diagonally to suit specific applications within the scope of the appended claims. In other embodiments, linear fasteners for mounting multiple coins may be sewn on the hat. In further embodiments, the linear fasteners may be sewn on a hat band. The hat band may be placed, for example, above the brim of a hat to display coins and other objects as described above.

Figure 6:
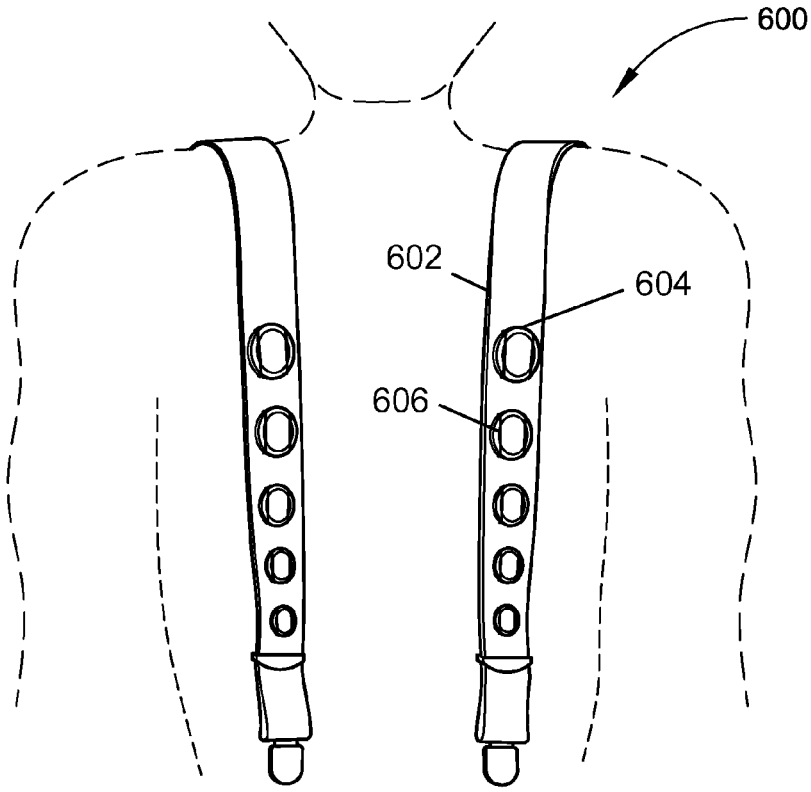
FIG. 6 illustrates a front view of an embodiment of the linear fastener of FIG. 1 sewn on a pair of suspenders for displaying coins.

FIG. 6 illustrates a front view 600 of an embodiment of the linear fastener of FIG. 1 sewn on a pair of suspenders for displaying coins. Shown in FIG. 6 are a pair of suspenders 602, round coins 604, a square coin 608, and linear fasteners 606 and 610.

Figure 7:
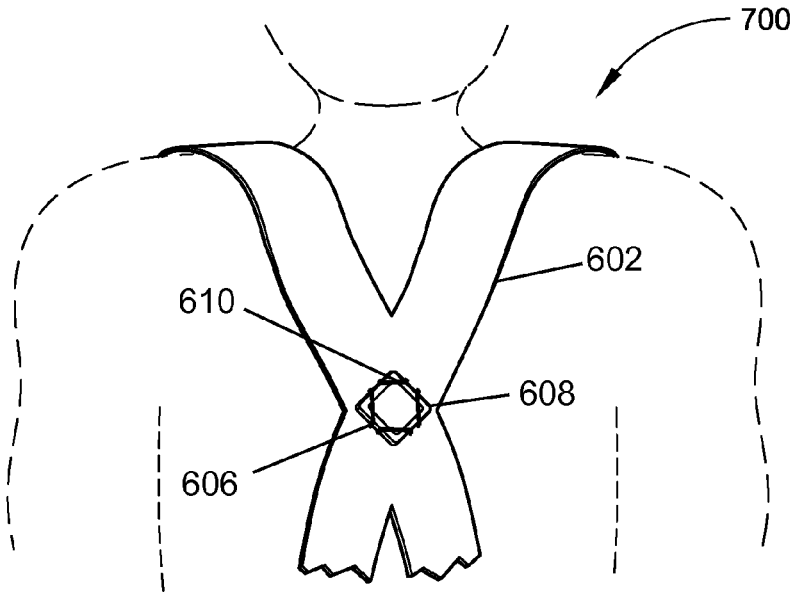
FIG. 7 illustrates a rear view of the embodiment of FIG. 6.

FIG. 7 illustrates a rear view 700 of the embodiment of FIG. 6. Shown in FIG. 7 are a pair of suspenders 602, a square coin 608, and linear fasteners 606.

In FIGS. 6 and 7, the pair of suspenders 602 is made with the linear fasteners 606 sewn to the suspenders 602 according to well-known techniques. In this embodiment, the linear fasteners 606 are oriented parallel to the weight vector of the round coins 604 in FIG. 6 and the square coin 608. In FIG. 7, the linear fasteners 610 are oriented perpendicular to the weight vector of the square coin 608. In other embodiments, the coins 604 and 608 may be of varying sizes, shapes, and kinds. For example, the coins 604 may be round ship's coins commemorating a naval career. In further embodiments, the coins 604 may be monetary coins or campaign buttons. In another embodiment, postage stamps or thumbnail photos may be mounted on suitable backing plates and held on the suspenders 602 by the linear fasteners 606. The square coin 608 may be mounted on the back of the suspenders, for example, to display a brand name for the manufacturer of the pair of suspenders 602 for displaying coins and other objects.

Figure 8:
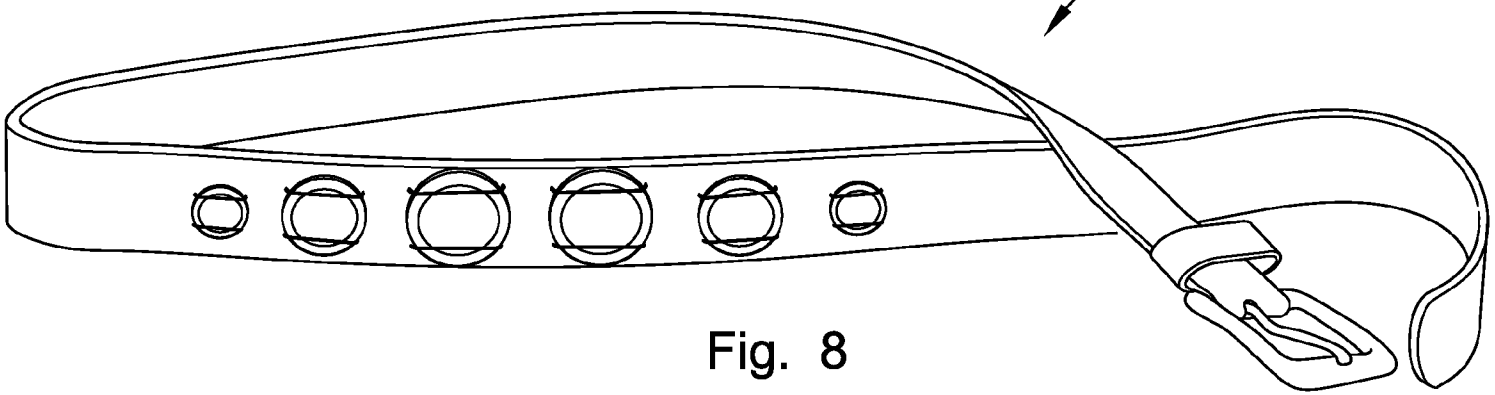
FIG. 8 illustrates a perspective view of an embodiment of the linear fastener of FIG. 1 sewn on a belt for displaying coins.

FIG. 8 illustrates a perspective view 800 of an embodiment of the linear fastener of FIG. 1 sewn on a belt for displaying coins. In this embodiment, the linear fasteners are oriented perpendicular to the weight vectors of the coins.

Although the flowcharts described above show specific steps performed in a specific order, these steps may be combined, sub-divided, or reordered within the scope of the appended claims. Unless specifically indicated, the order and grouping of steps is not a limitation of other embodiments that may lie within the scope of the claims.

The specific embodiments and applications thereof described above are for illustrative purposes only and do not preclude modifications and variations that may be made within the scope of the following claims.

What is claimed is:

1. An apparatus comprising:

an elastic surface;

a first flexible, linear fastener attached to the elastic surface at opposite ends of the first linear fastener separated by a distance that is less than a diameter of an object to be fastened to the elastic surface;

a second flexible, linear fastener attached to the elastic surface at opposite ends of the second linear fastener separated by a distance that is less than the diameter of the object, the first and second linear fasteners separated by a distance sufficient to insert a leading edge of the object between the first linear fastener and the elastic surface and to insert a trailing edge of the object between the second linear fastener and the elastic surface;

a plurality of anchor points on the elastic surface at each of the opposite ends of the first and second linear fasteners, each plurality of anchor points including a first anchor point on the elastic surface under the object and a second anchor point on the elastic surface outside the object; and wherein the object comprises one of a monetary coin, a ship's coin, a campaign button, a photograph, and a postage stamp.

2. The apparatus of claim 1 further comprising the first linear fastener attached to the elastic surface by the second anchor point outside the object to tighten the first linear fastener against the object when tension is applied to the elastic surface in a direction that increases the distance separating the opposite ends of the first linear fastener.

3. The apparatus of claim 1 further comprising the first linear fastener attached to the elastic surface by the first anchor point under the object to tighten the first linear fastener against the object when tension is applied to the elastic surface in a direction that decreases the distance separating the opposite ends of the first linear fastener.

4. The apparatus of claim 3 further comprising the first linear fastener attached to the elastic surface by the second anchor point outside the object to tighten the first linear fastener against the object when tension is applied to the elastic surface in a direction that increases the distance separating the opposite ends of the first linear fastener.

5. The apparatus of claim 1, the first linear fastener comprising multiple stitches.

6. The apparatus of claim 5 further comprising the multiple stitches sewn to the elastic surface in an overhand stitch.

7. The apparatus of claim 5 further comprising a wrapping stitch sewn around the multiple stitches.

8. The apparatus of claim 1, the first linear fastener comprising a transparent material.

9. The apparatus of claim 1, the elastic surface comprising one of a belt and a pair of suspenders.

* * * * *